United States Patent [19]

Klemer

[11] 4,078,735

[45] Mar. 14, 1978

[54] MULTICOIL TRAVERSE WINDER

[75] Inventor: Bernard H. Klemer, Providence, R.I.

[73] Assignee: The Entwistle Company, Hudson, Mass.

[21] Appl. No.: 646,761

[22] Filed: Jan. 6, 1976

[51] Int. Cl.[2] ..... H01F 41/06; B65H 54/10

[52] U.S. Cl. ..... 242/7.09; 242/25 A

[58] Field of Search ..... 242/7.09, 7.16, 18 A, 242/25 A, 80, 158

[56] References Cited

U.S. PATENT DOCUMENTS

| | | | |
|---|---|---|---|
| 1,975,620 | 10/1934 | Saul | 242/7.09 |
| 3,011,728 | 12/1961 | Klinksiek | 242/7.09 |
| 3,093,345 | 6/1963 | Dzugan | 242/158.4 R |
| 3,128,956 | 4/1964 | Schümann | 242/7.09 |
| 3,166,104 | 1/1965 | Foley et al. | 242/7.09 X |

*Primary Examiner*—Billy S. Taylor

*Attorney, Agent, or Firm*—Barlow & Barlow

[57] ABSTRACT

The invention provides a means of automatically winding several wire coils on a common reel with a fixed space between the coils. The width of the coils is adjustable with a hand wheel, and the quantity of coils may be selected. The gap distance between coils is also selectable by means of a selector switch. The automatic control of coil transfer, coiler slow down, and stopping at the end of the last coil is provided by a counter which measures the length of wire being wound on the coiler. The proper footages are set on the counter and as these lengths are reached signals are provided to the traverse system and drive to initiate the appropriate actions.

2 Claims, 2 Drawing Figures

F I G. I

MULTICOIL TRAVERSE WINDER

BACKGROUND OF THE INVENTION

The present invention relates to a wire coiling mechanism and in particular to a device for winding a plurality of individual coils on a single reel core onto a collapsible winding drum or the like. In the past it has been common to wind wire onto reels or the like and devices of this general type are known as dual head winders. In utilizing this type of mechanism, the wire would traverse a first reel and then shift and traverse a second reel and then repeat the sequence. However, there has not been a single winding device which would take a strand of wire and wind it on a common core with spaced adjacency coils.

SUMMARY OF THE INVENTION

Winding apparatus is provided which has at least one spindle upon which wire strands may be wound with means for traversing the strand along only a portion of the axial extent of the spindle. The device provides means for transferring the traverse to another portion of the axial extent of the spindle together with means which will measure the length of the strand wound which will actuate the transferring means to move the traverse to another axial extent of the spindle. Also provided by the mechanism in its disclosed form are devices which will allow the operator to change the spacing between the coils wound and automatic means to insure slowing down of the winder and stopping the winding operation when a complete set of coils have been wound.

DESCRIPTION OF THE PREFERRED EMBODIMENT

Figure 1:
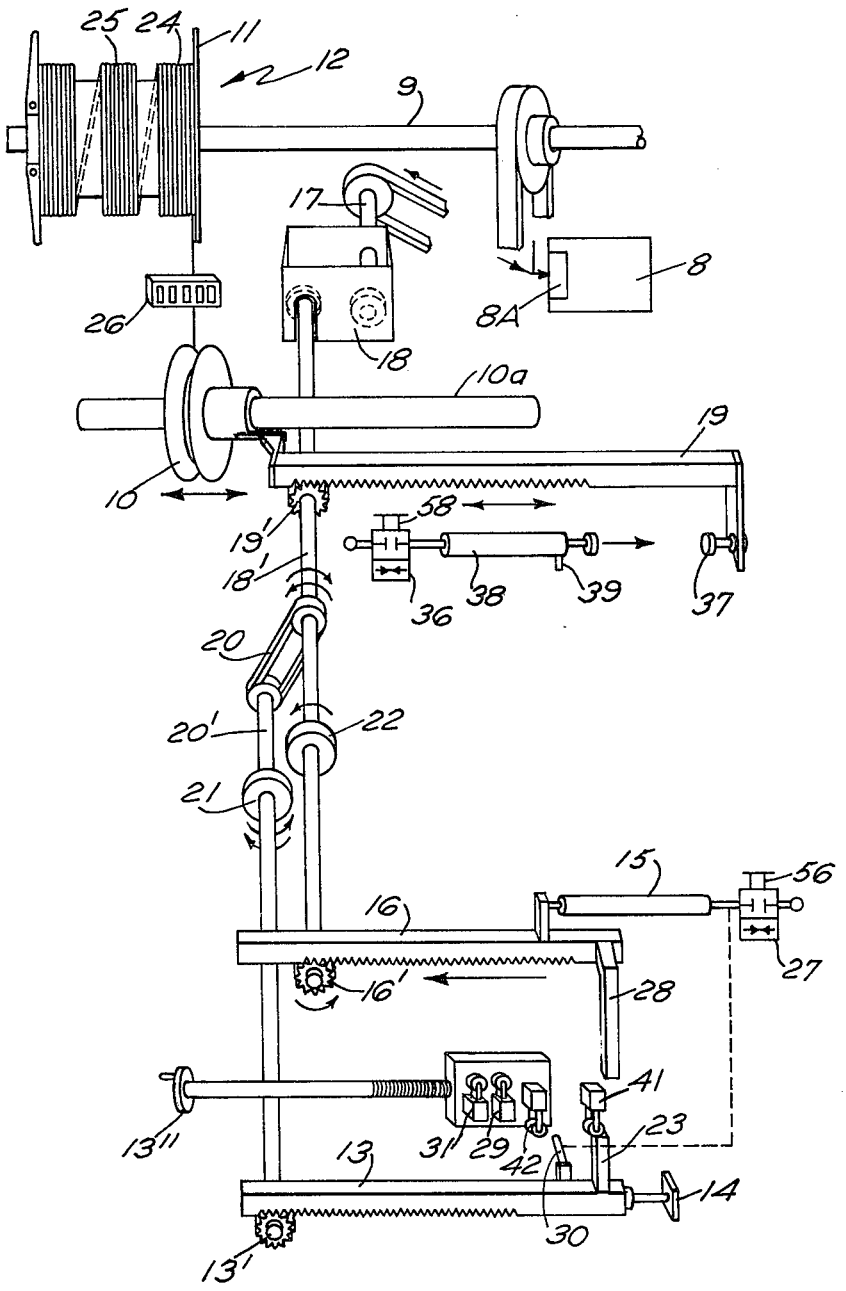
FIG. 1 is a diagrammatic view illustrating the essential elements of the invention.

With reference to FIG. 1 of the drawings in which a diagrammatic representation of the machine has been presented, there is a main winding shaft designated by the reference numeral 9 which in suitable fashion drives a reel generally designated 12. The manner in which the shaft engages the reel can take a variety of forms as well known to those skilled in the art, such as stub shaft engagement, or a coiling reel as shown in U.S. Pat. No. 3,704,839 may be used. The main source of a motive power is diagrammed at 8 with clutch 8A and this in turn drives the shaft 9 and also drives traverse in and out clutches generally designated 18 via an input shaft 17. The output shaft 18' has a pinion 19' mounted thereon which drives a traverse rack 19 to and fro in an oscillating manner. Additionally shaft 18 has a takeoff chain or timing belt drive 20 thereon which rotates a secondary shaft 20' through a clutch 21 to a pinion 13', that drives a coil width rack 13. A continuation of shaft 18' through a clutch 22 and thence to pinion 16' drives a transfer slide rack 16.

The traverse rack 19 has mounted thereon a traverse guide sheave 10 which is adapted to slide on a suitable guide bar **10*a*. The traverse rack may be moved by a re-set cylinder 38 which engages an abutment 37 that is affixed to the rack 19. The re-set cylinder 38 is actuated by a two-way valve 36 controlled by solenoid 58. Transfer slide rack 16 has affixed thereto a transfer cylinder or linear actuator 15 which is actuated by a two-way valve 27 controlled by solenoid 56. Shown diagrammatically is a trip dog bar 28 which engages switches 29 and 31 respectively in a manner which will presently be described. At the end of the coil width rack 13 is an adjustable stop 14 and coming into lateral engagement with the rack 13 is a snubber cylinder 30 which acts as a brake to grip the rack and prevent it from moving under certain condition. Shown diagrammatically is a trip dog bar 23 which engages switches 42 and 41 in a manner which will be described. The switches 29, 31 and 42 are commonly mounted on an adjustable platform which can be moved relative to the coil width rack 13 and to this end there is diagrammatically indicated an adjusting wheel 13"** with its associated threaded screw. To understand how these parts are related, the operational sequence will now be described.

At the start of a run, the traverse sheave 10 is positioned to the right in FIG. 1 in line with the rear flange 11 of the coil head 12. At this time the coil width rack 13 will be to the right in FIG. 1 against top 14, and the transfer cylinder 15 will be fully retracted thereby pulling the slide rack 16 to the right as seen in FIG. 1. Since the machine drive is not running, the traverse system is stationary. At this point the machine is ready to run.

To start the drive, push button switch is depressed which energizes coil 8A which turns on drive clutch system. Switch 41 is closed by the engagement of bar 23 thereby energizing coil 47 and its associated contacts **47*b*, 47*c* and its holding contact 47*a*, which latches the coil through switch 42 and normally close contacts 50*b* and 62*a*. Power is transmitted to the input shaft 17 of the traverse in-out clutch assembly 18 through the out clutch 18*a* which is now energized through normally closed contacts 54*c*, 62*b*, 47*b*, and 50*a*. Rotative power is now transmitted to the traverse gear and rack 19 causing the rack to move to the left as seen in FIG. 1. At the same time mechanical power is transmitted through the chain drive 20 to the coil width clutch 21 which is energized through normally closed contact 54*b* and 62*c* and with the clutch energized the coil width rack 13 is now locked to the traverse rack 19 and moves with it. At this time the slide clutch 22 connected through normally open contact 54*d* is not energized. The traverse and coil width racks 19, 13 will continue to move together until the coil width trip dog 23 hits normally closed switch 42. This action will electrically de-energize the out clutch 18*a* by de-energizing coil 47 and energizing the in clutch 18*b* in assembly 18 by closing contact 47*c*, thereby reversing the direction of motion of the two racks 19, 13. As a result, the traverse sheave 10 will now move to the right as viewed in FIG. 1 until the coil width trip dog 23 hits limit switch 41 which is normally open, and this will again energize relay coil 47 and cause the in-out traverse clutches in assembly 18 to reverse their operation and the sequence repeats itself. It will be apparent that the two racks 19, 13 will reverse their direction causing the traverse sheave to move out and in this manner the traverse sheave moves back and forth across the coil head producing a coil 24 whose width will be equal to the distance set between the limit switches 41 and 42**.

When it is time to transfer the traverse sheave 10 to the second coil position 15, it is necessary to first bring the traverse back to the coil start position in line with flange 11, hold it there momentarily, and then transfer quickly to the beginning point of the next coil 25 at which time the traverse sheave 10 will immediately commence moving back and forth again. The sequence for this operation is as follows:

When the length of wire on the coil head equals the amount set on the warning preset 26*a* of the predetermining counter 26, switch 44 closes energizing coil 50 and closing its timed contact 50' for a short period of time in the order of 0.5 second. This causes relay 47 to de-energize and the traverse in clutch 18*b* in assembly 18 is energized by contact 47*c* causing the traverse sheave 10 and coil width rack 13 to move to the right as viewed in FIG. 1 until the coil width dog 23 trips switch 41 closing contacts 47*a* and 47*b* while opening contact 47*c*. Normally closed contact 50*a* having been opened prevents the traverse out clutch from energizing and thus the traverse sheave will remain stationary with both traverse in-out clutches de-energized while the system waits for a signal from the counter 26.

When the length of wire on the coil equals the amount set on the transfer present 26*b* of the counter 26 contact 45 closes momentarily and coil 52 is energized closing contact 52*a* and energizing coil 54. At the same time relay coil 50 drops out. Coil 54 latches itself through either switch 29 or 31 and with contact 54*b* opening this causes the coil width clutch 21 to de-energize and release while the slide clutch 22 energizes through contact 54*d*, thereby locking the traverse rack 19 to the transfer slide rack 16. At the same time the transfer cylinder solenoid 56 is energized causing the valve 27 to open and the cylinder 15 to extend and push the transfer slide rack 16 out to the left as viewed in FIG. 1. Since slide rack 16 is locked to traverse rack 19, the traverse sheave will move with it until the trip dog 28 trips switch 29 or 31. Thus the traverse rack and the sheave have moved out to the left in FIG. 1 a distance equal to the coil width plus two inches, for example, which would be the distance between switch 41 and 29. When switch 29 is actuated by the trip dog 28 so that it is now open, coil 54 and the transfer cylinder solenoid de-energizes causing the slide rack to retract to the right to its mechanical stop and original position. Switch 41 having been closed by trip dog 23 will energize traverse out clutch 18d*a* when contact 54*c* closes, while the coil width clutch 21 energizes (contact 54*b* closing) causing the traverse sheave 10 and the coil width rack 13 to move out to the left in FIG. 1 and commence moving back and forth between the limit switches 41 and 42. During the movement of the slide rack and traverse sheave a small snubber cylinder 30 (see FIG. 1) is connected to the air line of valve 27 and is provided to press against the coil width rack 13 while the transfer cylinder is extending in order to prevent the coil width rack 13 from accidentally shifing position during the transfer. If coil width rack 13 moved, the next coil would not begin winding at the proper location. As just noted, when the coil 54 de-energizes, this also de-energizes the solenoid 56 which controls the transfer cylinder valve 27 due to the fact that contact 54*a* is opened, and accordingly, cylinder 15 retracts the transfer slide rack 16 back to its mechanical stop original position and additionally the snubber cylinder 30 retracts from against the rack 13.

Figure 2:
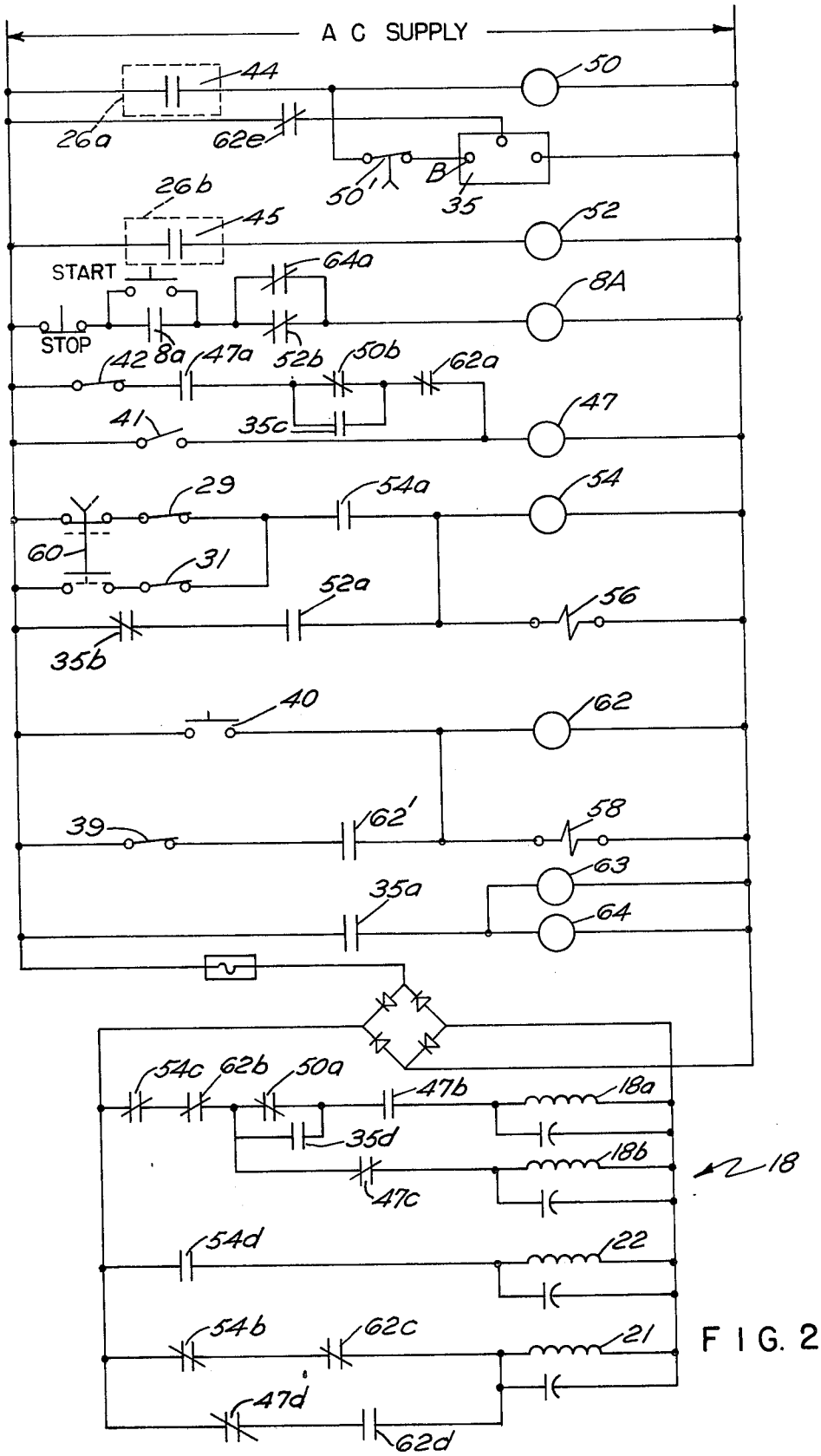
FIG. 2 is an electrical schematic showing in standard two-line form the switches and relays which permit the automatic operation of the device.

It was mentioned above that the traverse rack during its movement would engage either switch 29 or 31. Switch 31 is provided spaced from switch 29 a finite distance say, for example, an additional two inches, and at the operator's selection a switch 60 which is a selector switch as seen in FIG. 2 may be actuated so that the gap space between the coils can be selected for either two inches or four inches.

The number of coils which are to be wound on the spindle or reel may be selected by an operator through the utilization of an impulse counter 35 (FIG. 2) which is responsive to electrical impulses. It will be seen by referring to the diagram in FIG. 2 each time that the relay coil 50 is operated there is an instantaneous impulse that is put into terminal B of the counter 35 by timed contact 50'. This counter is provided with a contact 35*a* and if, for example, it is set for three coils as illustrated in the example herein when the contact 44 closed on the preset length counter the counter 35 would then actuate its contact 35*a*, which in turn would energize one or more solenoids 63 or 64 which in turn through circuitry that is not illustrated will actuate transfer contact in motor slow down circuitry that is well known to those skilled in the art.

In addition, when the last coil is being wound and after the contact 44 has closed and the speed of the winding has slowed down, contact 35*c* closes to maintain relay coil 47 and its associated contacts in a circuit condition and thereby maintain the traverse out clutch 18*a* active in order to maintain normal traverse operation. This includes the contact 35*d* that bypasses contact 50*a*. Additionally, at the end of the wind for the last coil, contact 45 will pull in actuating relay coil 52. However, contact 52*a* is ineffective since normally closed contact 35*b* of the counter 35 has now opened and a circuit is not made to the transfer relay coil 54 or to the transfer out solenoid 56. Also when coil 52 actuates, normally closed contact 52*b* opens, and since contact 64*a* is already open, clutch 8A is now de-energized and the motive power connection to the shaft 9 is disconnected.

At this point the wire may be unloaded. It is now necessary to reset the system and the traverse sheave return to its starting position. In order to accomplish this, a momentary button switch 40 is pushed which energizes this relay coil 62 and solenoid 58 that operates valve 36 which applies air to the cylinder 38 to push the traverse rack 19 back to its rear stop 37. Contacts 62*a, b* and *c*, all open the traverse in-out clutch circuits to allow the traverse rack to be pushed back to its mechanical stop, while contact 62*d* closes allowing the coil width clutch 21 to be energized and also returned to its mechanical stop. At this point trip dog 23 hits switch 41 energizing coil 47 and opening contact 47*d* which in turn de-energizes coil width clutch. Thus the traverse rack 16 and the coil width rack 13 are re-positioned to their starting points since the coil width rack 13 will hit its stop before the traverse rack 19 does, the coil width clutch 21 will slip until the traverse rack 19 stops and hits switch 41 as explained above. When the reset cylinder 38 extends fully, it actuates built-in limit switch 39 which de-energizes the solenoid 58 and drops out relay coil 62 causing reset cylinder 38 to retract. The traverse system is now ready to begin operating again.

Turning the adjusting wheel 13'' causes the mounting block that holds switches 29, 31 and 42 to move in or out. Since switch 42 sets the outer limit of the coil winding width, moving it out, for example, will allow the traverse to cover a wider span thereby winding a wider coil. The gap between coils is still maintained by switches 29 or 31.

I claim:

1. Winding apparatus for winding spaced coils on a spindle comprising a spindle upon which a strand may be wound, means for traversing a strand along a portion of the axial extent of said spindle in an oscillating manner to obtain a flat wound coil on the spindle, means for transferring the traversing means to another portion of the axial extent of said spindle, comprising a transfer slide and linear actuator means mechanically coupled thereto, a clutch, a counter engaging the strand and having means generating a first signal, said clutch responsive to a first signal to couple the transfer slide to the traverse means, the actuator means responsive to the first signal to move the transfer slide and traverse means in a first direction to a new position, a switch, said switch actuated by movement of the transfer slide to generate a second signal, said clutch being responsive to a second signal which uncouples the clutch, the linear actuator being responsive to the second signal to move the transfer slide in a second direction to its original position.

2. Winding apparatus for winding spaced coils on a spindle as in claim 1 wherein the means for generating said first signal is an electrical contact coupled to the counter which is closed when a measured amount of strand is wound on the spindle.

* * * * *